United States Patent [19]

Gilb

[11] 4,094,116

[45] June 13, 1978

[54] WEB TUBE WITH SEPARATED END WALLS

[75] Inventor: Tyrell T. Gilb, Berkeley, Calif.

[73] Assignee: Simpson Manufacturing Co., Inc., San Leandro, Calif.

[21] Appl. No.: 803,443

[22] Filed: Jun. 6, 1977

[51] Int. Cl.[2] ..... E04C 3/292

[52] U.S. Cl. ..... 52/693; 403/217; 403/388

[58] Field of Search ..... 52/693, 695; 403/94, 403/388, 380, 91, 217, 219

[56] References Cited

U.S. PATENT DOCUMENTS

| | | | |
|---|---|---|---|
| 1,556,589 | 10/1925 | Clark et al. | 52/695 X |
| 2,408,907 | 10/1946 | Booth | 403/380 |
| 3,386,222 | 6/1968 | Troutner | 52/693 |
| 3,564,783 | 2/1971 | Dunne | 52/693 |
| 3,570,204 | 3/1971 | Birkemier | 52/693 |
| 3,857,218 | 12/1974 | Gilb | 52/692 X |
| 3,946,532 | 3/1976 | Gilb | 52/692 |

*Primary Examiner*—Alfred C. Perham
*Attorney, Agent, or Firm*—James R. Cypher

[57] ABSTRACT

A tubular web having a generally circular cross section in the body portion; tapering at its ends in a symmetrical manner and terminating in an end portion having generally flat outside surfaces with the distinguishing characteristic being in the separated end walls. An opening is formed in the separated end wall flat areas for receiving a metal connector pin.

1 Claim, 11 Drawing Figures

WEB TUBE WITH SEPARATED END WALLS

BACKGROUND OF THE INVENTION

Tubular metal webs with thin flat ends have been used for constructing wood chord trusses for such a long time and in such great quantity that they have become an unquestioned standard in the truss industry. The flat thin ends, however, pose a nagging problem; under compression, the webs buckle at a small fraction of the load the webs are capable of withstanding in tension.

Troutner, U.S. Pat. No. 3,137,899, June 22, 1964 was one of the earliest to use a tubular metal web with thin flat ends in his composite wood chord light truss. The thin flat end web was an easy choice since such webs with thin flat ends had been used since the early thirties in all-metal light trusses as shown e.g. in Wooldrige, U.S. Pat. No. 1,813,373, July 7, 1931. Troutner was soon followed by Birkemier U.S. Pat. No. 3,570,204, Mar. 16, 1971; Peters, U.S. Pat. No. 3,961,455, June 8, 1976 and Gilb, U.S. Pat. No. 3,857,218, Dec. 31, 1974; all using the tubular web with the thin flat ends.

Web buckling was not a serious problem in light composite trusses since all of the trusses except the Gilb trusses, failed at maximum load at the interface of the metal pin and the wood chord by chord splitting.

Web failure became an acute problem, however, in the medium and heavy truss series which used four wood chords. Troutner, U.S. Pat. No. 3,386,222 tried to solve the web buckling problem at the thin flat ends by forming diagonal asymmetrical shoulders in the web ends. Even though the Troutner web still did not basically solve the buckling problem, because it still was constructed with a long thin flat area adjacent the pin opening, it was apparently sufficient for the Troutner truss with its basic metal pin and bored wood chord joint.

In 1976, however, the Gilb U.S. Pat. No. 3,946,532, Mar. 30, 1976, *Truss Structure With Fastener Plate Joint Assembly* made a quantum jump in medium and heavy truss joint load values. The Gilb prong plates with metal to metal contact suddenly made metal compression webs with thin flat ends obsolete. Further increases in load value for medium and heavy series trusses awaited the invention of a stronger compression web.

Finally, while working on a different project to improve the light series truss line, Gilb invented a new truss joint connector which has been named the "clevis". The "clevis" truss had such high load value at the joints that even oversized webs with the standard thin flat ends were unable to meet the high loads imposed. Gilb filed application Ser. No. 758,061 on Jan. 10, 1977 on the clevis assembly joint. Buckling failures in the thin flat ends of the webs had to be solved or the development of higher load value connectors for the light-weight series of composite trusses would be at a standstill.

SUMMARY OF THE INVENTION

Discarding the web designs which had been accepted as the standard for 46 years and facing the stultifying effect of thousands of successfully commercially erected trusses with webs having thin flat web ends, Gilb solved the buckling web problem by separating the end walls by a fraction of an inch and obtained an amazing 40% increase in the ability of the web to resist localized buckling at the ends.

The new web end configuration of the present invention can be used in the light composite truss series as shown in Gilb patent application Ser. No. 758,061 filed Jan. 10, 1977, and in the medium and heavy series of composite trusses as shown in Gilb U.S. Pat. No. 3,946,532 Mar. 30, 1976, Troutner U.S. Pat. No. 3,386,222, June 4, 1968, and other double chord trusses.

The present web design is not limited to composite trusses and may be used in all-steel trusses, which use pin connectors.

An unexpected beneficiary of the present web end design is the metal scaffolding industry. At the present time, double "X" bracing is required because reversals in load place the bracing in compression. Because of the buckling of the ends of the webs, two braces are needed. With the use of the present end design, only one brace will be required and it is expected that nearly half of the cross bracing can be eliminated.

DESCRIPTION OF THE PREFERRED EMBODIMENTS OF THE INVENTION

Figure 1:
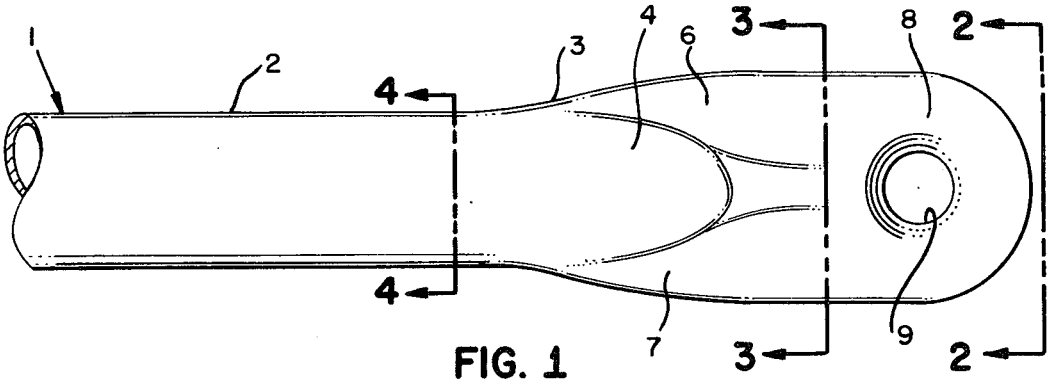
FIG. 1 is a plan view of a portion of a tubular steel web with an end constructed in accordance with the present invention.
Figure 2:
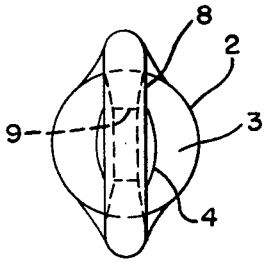
FIG. 2 is an end view of the web shown in FIG. 1.

The web 1 of the present invention for a truss structure is formed from a thin-walled metal tubular member such as a 19 gauge pipe. The elongated tubular body portion 2 may be circular in cross-section. A tapered transition portion 3 including a bulb section 4 is integrally connected to the body portion. Flat side portions 6 and 7 are formed on both sides of the bulb section. A flattened end portion 8 is formed adjacent the transition portion with a pin opening 9 therethrough. The walls of the tubular member are separated from one another in the transition portion as in the prior art webs. The unique feature, however, is the fact that the walls are also separated in the flattened end portion between the opening and the body portion forming a space indicated by the number 11. A typical web may have a 1 inch outside diameter and be formed from welded steel tube conforming to ASTM Specification A-570, Grade C with a minimum yield strength of 45,000 psi and a minimum ultimate tensile strength of 60,000 psi. Web lengths for trusses may vary considerably and of course web lengths for scaffolding may be 4 to 6 feet in length.

Figure 7:
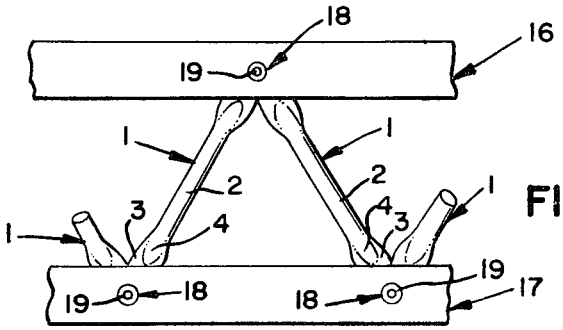
FIG. 7 is a portion of a typical composite truss of the medium or heavy series showing one type of truss in which either the prior art tubular web or the web of the present invention may be used.
Figure 3:
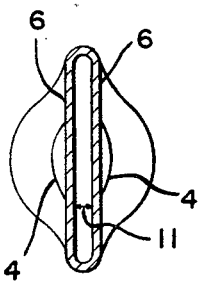
FIG. 3 is a cross-sectional view of the web of FIG. 1 taken along line 3—3.
Figure 4:
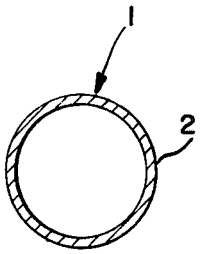
FIG. 4 is a cross-sectional view of the web of FIG. 1 taken along line 4—4.

Webs as above described are used in medium and heavy series composite trusses such as the one shown in FIG. 7 having double wood members for the top chords 16 and bottom chords 17. The joint means 18 for such trusses are fully described in trusses such as Troutner U.S. Pat. No. 3,386,222, Birkemier U.S. Pat. No. 3,570,204, Peters U.S. Pat. No. 3,961,455; and Gilb U.S. Pat. No. 3,946,532. All of these trusses have pins 19 for connecting the chords to the openings in the webs.

The webs of the present invention may also be used in light series trusses such as Troutner U.S. Pat. No. 3,268,251 but they are particularly adapted for use with Gilb, U.S., Ser. No. 758,061 filed Jan. 10, 1977. Such trusses are formed with upper and lower wood chords 21 having transverse wood bores for the receipt of pins 22.

Figure 9:
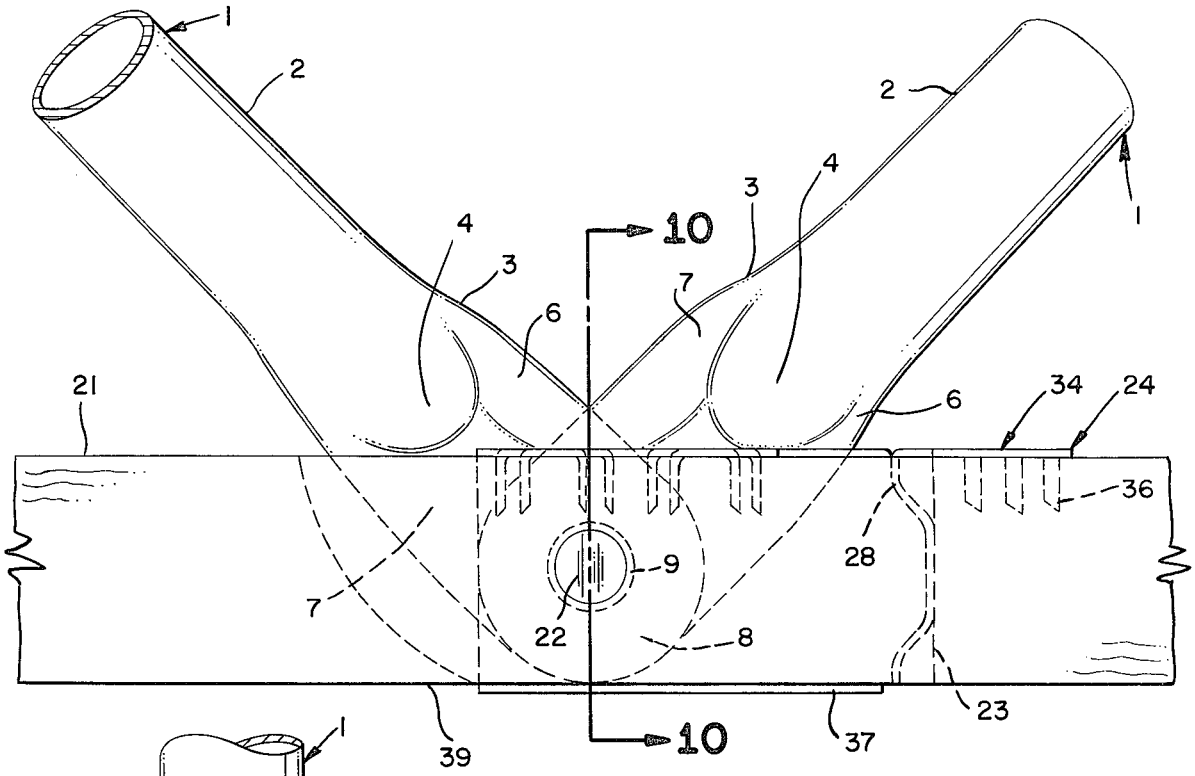
FIG. 9 is a side view of the portion of the truss shown in FIG. 8.
Figure 10:
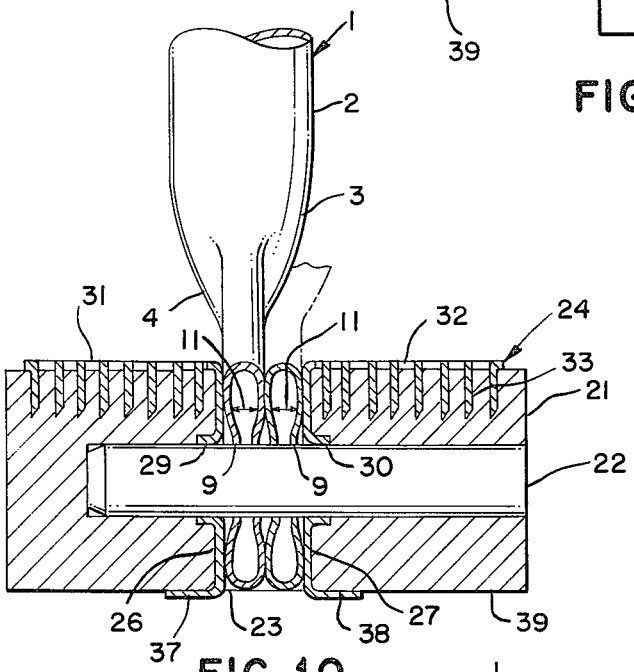
FIG. 10 is a cross-sectional view of the truss joint shown in FIG. 9, taken along line 10—10.
Figure 8:
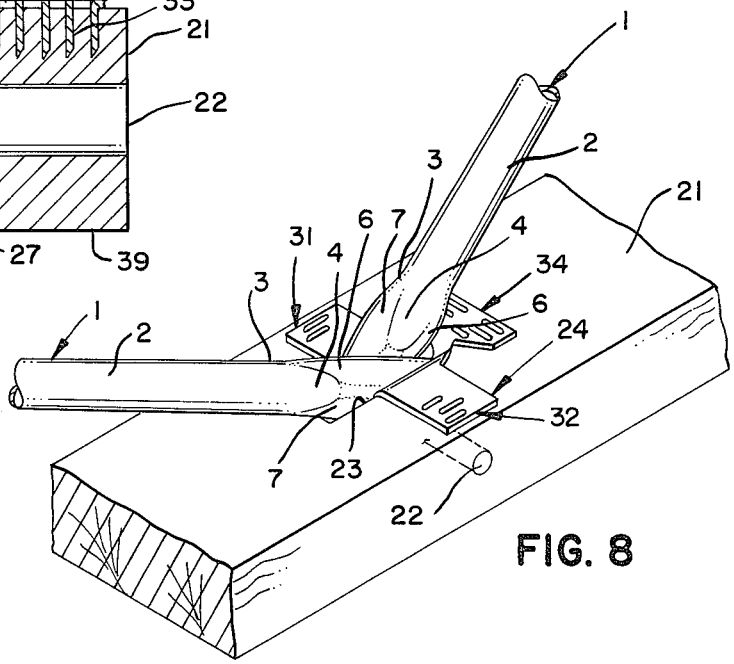
FIG. 8 is a portion of another form of light series composite truss illustrating the use of the web of the present invention.

As shown in FIGS. 8 – 10 such light series trusses may be formed with a plurality of slots 23 extending through the chords with a plurality of clevis members 24 inserted therein. The clevis members are formed with legs 26 and 27 jointed at an end 28 and free at their other ends for lateral movement. The clevis members are formed with aligned openings 29 and 30. Inner face flanges 31 and 32 are integrally connected at right angles to the inner edges of the legs. Prongs 33 attach the flanges to the inner faces of the chords. An end flange 34 integrally connected to the end portion is connected to the chord by prongs 36. Outside face flanges 37 and 38 connected to the legs engage the outside face 39 of the chords.

TEST RESULTS

A private testing lab conducted tests on webs as described in this application.

The webs were assembled in a fixture which was designed to simulate the capacity of the sample to resist load as a compression member when used in the MM or HH series trusses. Two opposed joint assemblies were mounted in a short section (12 inches long) of simulated chord elements of 2 × 4 F2400 Douglas Fir. Stub ends approximately 6 inches long were positionally mounted and angularly disposed to simulate tension members entering the MM-HH Type joint in the specified manner. The specimens tested were 15¾ inches center to center with identical end details.

The described test assemblies were placed with the opposed identical joint assemblies so that the element to be tested was vertical between the bed and the head of a Baldwin Universal testing machine. A dial gauge (reading to 0.001 inch) was mounted and set to "0" so that any vertical movement of the web in respect to the chord could be indicated. A 500-pound preload was applied and released. Load was then applied at a low rate in order to read the load and gauge readings at appropriate intervals.

TABLE

MM-HH TYPE 1" - 19 GA., 2-½" FLAT AREA TUBING × ¼" FLAT AREA WIDTH

| Rate of Loading | Movement of Assembly, Inches Test #1 | Test #2 | Test #3 | Remarks |
|---|---|---|---|---|
| 500 | | | | Preload |
| 0 | | | | |
| 500 | .005 | −.002 | .001 | |
| 1,000 | .005 | −.004 | .004 | |
| 1,500 | .007 | −.003 | .007 | |
| 2,000 | .008 | −.000 | .011 | |
| 2,500 | .010 | +.005 | .016 | |
| 3,000 | .014 | +.011 | .021 | |
| 3,500 | .022 | +.022 | .029 | |
| 4,000 | .041 | — | .055 | |
| Load Dropped: | 4150 | | 3700 | |
| Ultimate Load Pounds: | 4200 | 4235 | 4695 | |
| | (Localized Buckling) | | | |

For comparison, webs constructed in accordance with the prior art having thin flat ends were tested and failed at between 3000 and 3200 pounds.

Figure 11:
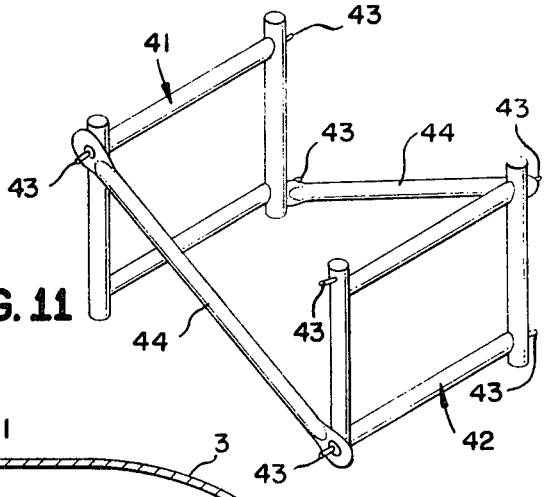
FIG. 11 is a perspective view of a scaffolding unit using the webs of the present invention.
Figure 5:
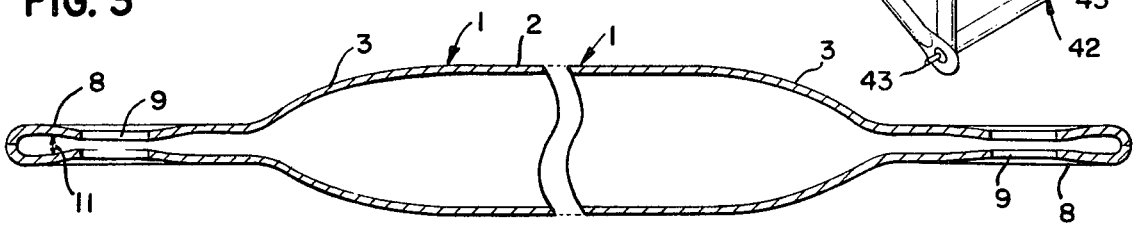
FIG. 5 is a longitudinal cross-sectional view of the web of FIG. 1 with the mid-portion removed.
Figure 6:
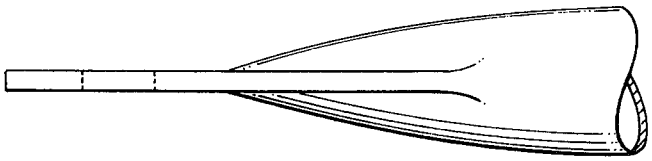
FIG. 6 PRIOR ART
FIG. 6 is a side view of a portion of a metal web of the prior art.

Another use of the present invention is for construction scaffolding as illustrated in FIG. 11. Scaffolding units 41 and 42 are formed with pin stubs 43 to which webs 44 of the present invention are attached. Webs 44 are identical to the webs shown in FIG. 1 except that they are much longer. The separated end walls make it possible to withstand much higher compression loads without buckling. In many instances, only a single brace or web 44 is required instead of two (2) braces in crossed relationship.

I claim:

1. In medium and heavy series composite wood chord and metal web member trusses having double wood members for the top and bottom chords and joint means including transverse bores formed in said chords, a metal joint connector connected to said chord and formed with an opening therethrough in registration with said transverse bores in said chord and a single metal pin at each of said joints inserted through said bores in said chords and said opening in said metal joint connector the improvement comprising:

a. a plurality of tubular metal web members formed from an open ended cylindrical metal tube formed with openings at both ends connected to said chords by said pins; and b. said tubular metal web members are formed with:

1. an elongated tubular body portion;
2. a smoothly tapered and unshouldered transition portion including a bulb section integrally connected to said body portion and flat side portions on both sides of said bulb section;
3. a smooth sided, unshouldered flattened end portion formed adjacent the transition portion with a pin opening therethrough;
4. said walls of said tubular member are separated from one another in said transition portion and said flattened end portion between said opening and said body portion; and
5. said walls of said distal ends of said tubular web members beyond said openings are in touching contact for maintaining the separation of said walls between said opening and body portion.

* * * * *